United States Patent [19]

Holt et al.

[11] Patent Number: 4,651,998

[45] Date of Patent: Mar. 24, 1987

[54] PROJECTILE TARGET GAME WITH SCORE KEEPING APPARATUS

[76] Inventors: David R. Holt, 2813 Yonge, Rockford, Ill. 61103; Thomas C. Harms, Jr., 6993 Senippa, Rockford, Ill. 61102; Robert B. Shepherd, 827 Tower Dr., Rockford, Ill. 61108

[21] Appl. No.: 746,518

[22] Filed: Jun. 19, 1985

[51] Int. Cl.[4] ..... F41J 3/02; F41J 5/04

[52] U.S. Cl. ..... 273/347; 116/225; 116/322; 235/71 R; 235/125; 273/374; 273/DIG. 26

[58] Field of Search ..... 273/374, 375, 376, 1 ES, 273/DIG. 26, 347; 116/222, 225, 322; 235/71 R, 86, 125; 434/426

[56] References Cited

U.S. PATENT DOCUMENTS

| | | | |
|---|---|---|---|
| 2,107,211 | 2/1938 | Pavelka | 273/376 |
| 2,950,048 | 8/1960 | Luhn | 235/71 R X |
| 3,281,071 | 10/1966 | Curran | 235/71 R |
| 3,454,276 | 7/1969 | Brenkert et al. | 273/376 |
| 3,468,478 | 9/1969 | Dunn | 273/71 R |
| 3,677,546 | 7/1972 | Oetiker | 273/374 |
| 4,057,251 | 11/1977 | Jones et al. | 273/376 |

FOREIGN PATENT DOCUMENTS

| | | | |
|---|---|---|---|
| 2130107 | 5/1984 | United Kingdom | 273/376 |

*Primary Examiner*—Anton O. Oechsle

[57] ABSTRACT

The invention relates to a projectile target game of the dart type which has individual player score keeping apparatus that includes a pair of nonrotatable shafts around which are loosely carried continuous belts which have an opaque background through which transparent numbers have been formed. Each digit of a number has a width substantially greater than the digits height. The continuous belt passes between a light source and a unidirectional magnifying lens which magnifies only the height dimension of the number's digits. The continuous belt is provided with score advance openings that are exposed via a slot in the face of the game that supports the target. The score advance openings are adjacent the transparent numbers such that a score may be made to appear in the magnifying lens. The target of the dart game is a dart board which has a unique bullseye target deflection detection mechanism. A controllable source of power is electrically coupled to a bullseye indication unit, a player score light source and a player selection circuit. The bullseye indication unit is controlled by the bullseye target deflection detection mechanism and the player selection circuit is controllingly coupled to a player selection array of lights. The bullseye indication unit provides an indication that the bullseye target has been deflected as a consequence of being struck by a projectile dart while simultaneously providing an illuminated image of a players score as indicated by one of the lights of the player selection array of lights.

23 Claims, 14 Drawing Figures

PROJECTILE TARGET GAME WITH SCORE KEEPING APPARATUS

TECHNICAL FIELD

This invention relates to multiple player projectile target game having multiple player score keeping apparatus.

BACKGROUND ART

The game of darts has had its popularity enhanced by the relatively recent development of "safe" darts that cooperate with a target that is provided with openings that receive blunt tips of the "safe" darts. The addition of automatic scoring to these "safe" dart and target arrangements have attracted commercial ventures such as bars, taverns and game arcades to install such equipment. The Jones U.S. Pat. No. 4,057,251 is typical of the state of the art. The dart games of the Jones patented type are particularly well suited for modification into becoming a coin operated game. The automatic scoring has made these dart games especially popular in the business environments hereinbefore noted. A frequent lament of players is that the commercially available dart game with its automatic costly and complex scoring mechanisms is too expensive for purchase and use at home. The invention to be described hereinafter distinguishes over the patent of Jones by providing an inexpensive multiple player "safe" dart and target game which is provided with a multiple player score keeping apparatus and a novel bullseye deflection detection and bullseye indication mechanism.

Another example of a projectile receiving target having a bullseye which when struck automatically provides a score for the player is shown in the B. E. Smolen et al U.S. Pat. No. 2,992,003. The Smolen et al patent, however, does not provide a compact self contained dart game with score keeping apparatus involving a single moving part for each players score computation.

The Smolen patent has multiple moving parts including linkages and levers whereas the score keeping apparatus of applicants invention has but a single moving part for each players score keeping apparatus.

SUMMARY OF THE INVENTION

The invention more specifically relates to a projectile target game of the dart type which has individual player score keeping apparatus that includes a pair of nonrotatable shafts around which are loosely carried continous belts which have an opaque background through which transparent numbers have been formed. Each digit of a number has a width substantially greater than the digits height. The continuous belt passes between a light source and a unidirectional magnifying lens which magnifies only the height dimension of the number's digits. The continuous belt is provided with score advance openings that are exposed via a slot in the face of the game that supports the target. The score advance openings are adjacent the transparent numbers such that a score may be made to appear in the magnifying lens.

The target of the dart game is a dart board which has a unique bullseye target deflection detection mechanism. A controllable source of power is electrically coupled to a bullseye indication unit, a player score light source and a player selection circuit. The bullseye indication unit is controlled by the bullseye target deflection detection mechanism and the player selection circuit is controllingly coupled to a player selection array of lights. The bullseye indication unit provides an indication that the bullseye target has been deflected as a consequence of being struck by a projectile dart while simultaneously providing an illuminated image of a players score as indicated by one of the lights of the player selection array of lights.

It is therefore a primary object of the invention to provide a projectile target game having a bullseye indicator and multiple player score keeping apparatus in which there is but a single moving element.

Another object of the invention is to provide a score keeping apparatus for a game which allows players of various heights to readily discern a players score in uniformly size numbers by means of a unidirectional magnifying means in cooperation with numbers on a moveable belt wherein the digits of the numbers each have a height less than a digits width.

Yet another object of the invention is to provide a dart board with a flexible central region containing a bullseye target wherein the bullseye portion of the dart board is deflected upon impact of a thrown dart which results in the actuation of a bullseye indication or alarm.

A still further object of this invention is to provide a moveable deflectable bullseye for a target with a novel switching mechanism that absorbs the shock of a projectile striking the moveable bullseye of the target while providing freedom from binding of the moveable bullseye with the target.

In the attainment of the foregoing objects the invention contemplates as being within its purview a score keeping apparatus in combination with a projectile receiving target game.

The projectile receiving target is secured to a surface of a face support plate which is mounted on a frame which has an upper end and a lower end. A slot in the face support plate provides an opening through the face support plate. Parallel non-rotatable guide shafts are secured at their respective ends to the frame at the upper and lower ends thereof. The non-rotatable guide shafts are positioned on one side of the face support plate and the target is on the other side. A window is fashioned in the face support plate adjacent the slot and within the window there is fitted a unidirectional magnifying lens. The lens has a length greater than its width. The unidirectional magnifying lens positioned in the window provides magnification only across its width. A mask cooperates with a surface of the unidirectional magnifying lens to provide a dimensionally controlled image field to thereby limit the dimensions of an image field to be magnified.

A light source is positioned adjacent the window and on the same side of the face support plate as the parallel non-rotatable guide shafts. The light source provides illumination to the image field.

A guide plate is secured to the face support plate in a spaced apart manner between the light source and the face support plate. The guide plate has an aperture therethrough which is positioned to matingly match the window.

A continuous belt is loosely carried by the non-rotatable guide shafts, with the belt passing between the guide plate and the face plate. The continuous belt is characterized by having an opaque background into and through which transparent numbers have been formed, each digit of the numbers having one of its dimensions reduced to thereby provide each digit of a number that is substantially wider than its height. The continuous belt is further characterized by having score advance openings there through adjacent each of the transparent numbers.

The continuous belt is moveable between the guide plate and the face support plate such that the digits of the numbers will appear consecutively at the window upon movement of the belt around the guide shafts, the score advance openings simultaneously appear within the slot. The just described arrangement allows for the manual insertion of a score adjusting probe within the score advance opening in the belt to thereby allow a player by movement of the score adjustment probe towards an end of the frame to thereby adjust the players score as evidenced by an illuminated magnified image of numbers appearing within the window and the image field. The magnified image presented is therefore a numeral wherein each digit thereof appears to have equal width and height without regard to relative angle a players eye is in respect of the unidirectional magnify lens.

The invention contemplates the provision of circuitry which includes light sources, visual and audible alarms, as well as a selectable visual arrangement that indicates which player's turn to play is at hand.

The game board itself has a bullseye target plate integrally secured in a target plate carrying rib structure. The bullseye target plate has a plurality of preformed apertures therein to receive upon impact a projectile tip of a projectile thrown at the game board bullseye target plate. A support plate is positioned in a plane parallel to said target plate and is mechanically coupled to the rib structure at at least two points remote from said target plate such that said projectile tip impact in one of said bullseye target plate apertures causes said rib structure to deflect at least a given distance.

A rigid disc which has an overall configuration that matches the bullseye target plate is provided, as well as a resilient member secured to the support plate and the rigid disc. The rigid disc is spaced apart from the bullseye target plate and positioned in a plane parallel to the support plate.

A switch is carried by said support plate, with the switch located within said resilient member and positioned such that upon said impact of said projectile tip, the target plate is deflected through the given distance and then said projectile tip strikes said disc.

This just recited action thereby causes the resilient member to be compressed which allows the rigid disc to engage the switch to cause the switch to be actuated and provide the bullseye indication.

Other objects and advantages of the present invention will be apparent upon reference to the accompanying description when taken in conjunction with the following drawings:

DETAILED DESCRIPTION OF THE PREFERRED EMBODIMENTS

Figure 1:
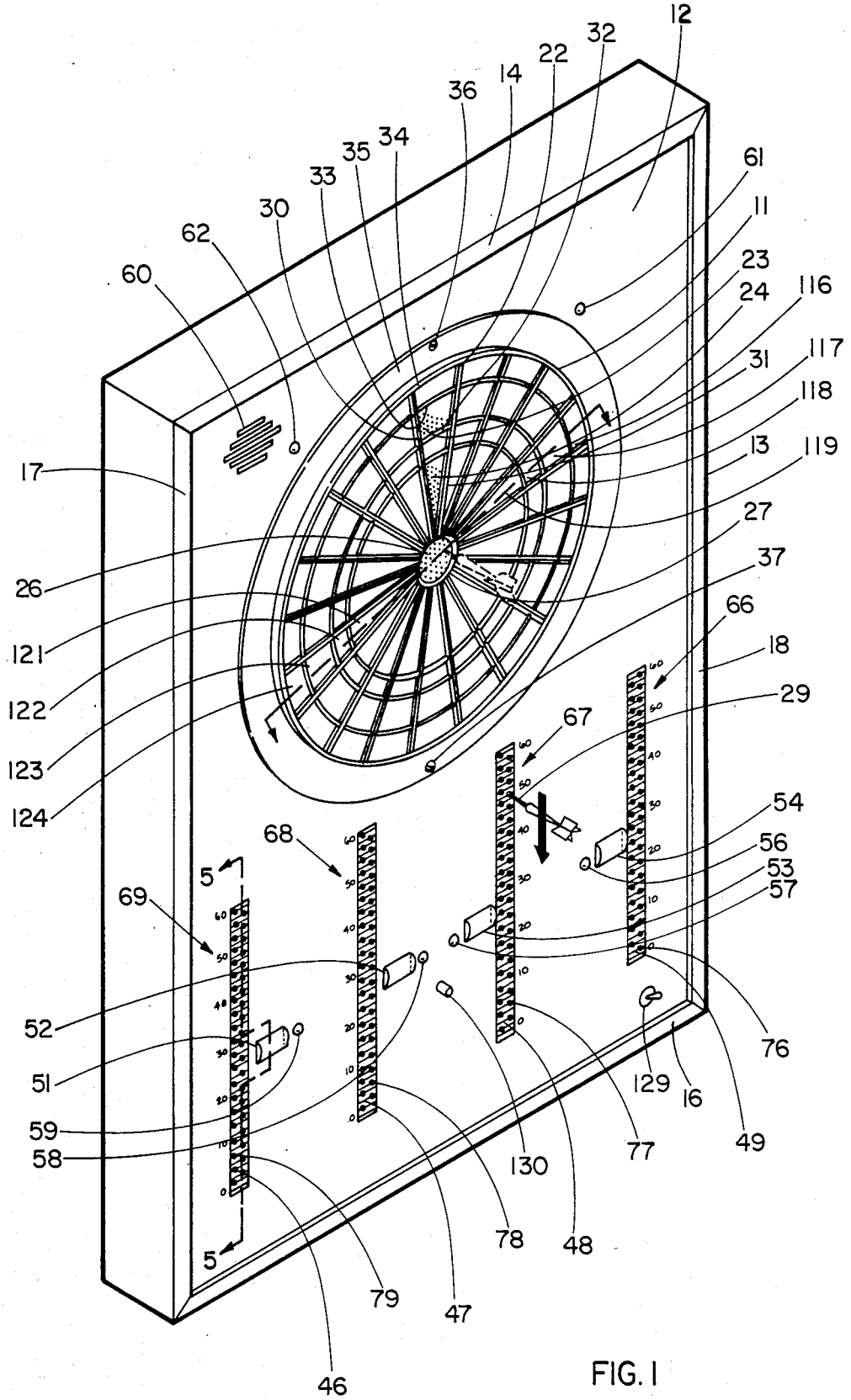
FIG. 1 illustrates in a three dimensional manner the projectile target with scorekeeping apparatus that embodies the invention.

Reference is now made to FIG. 1 which illustrates a preferred embodiment of the invention and shows in three dimensional detail a projectile target game in combination with scorekeeping apparatus. The projectiles employed in conjunction with game are of the "safe dart" type as shown and described in U.S. Pat. No. 4,057,251.

A dart board 10 is shown positioned on a face support plate 12. The dart board has integral therewith a circular flange 35 that is connected to the face support plate 12 by means of fasteners here shown in the form of screws 36, 37.

The overall configuration of the dart board 11 is identical in its layout to commercially available boards of the "safe dart" type. No novelty is asserted in respect of the dart board other than a unique bullseye deflection detection mechanism and a moveable bullseye switch arrangement to be described more fully hereinafter.

The dart board 10 is provided with a plurality of scoring regions defined by, for example by radial ribs 30, 31 and segmented circular ribs 32, 33, 34. The scoring regions just defined are comprised of non moveable target plates 22, 23 and 24 each of which is provided with a plurality of unreference preformed apertures into which safe dart tips piercingly cooperate.

A bullseye target plate 26 is shown surrounded by an annular rib 27. In dotted phantom outline an unreferenced dart is shown engaging an aperture in the deflectable bullseye target plate 26.

The face support plate 12 is secured to a frame 13 which is comprised of upper and lower frame members 14, 16 and side frame members 17, 18. The frame members 14, 16, 17 and 18 are secured one to other by any suitable means such as glue, nails etc. In a like fashion the face support plate 12 is fastened to the frame 13.

Directly beneath the dart board 11 there is shown the overall external configuration of the scorekeeping apparatus which includes a plurality of slots 46, 47, 48 and 49 which pass through the face support plate 12 and reveal respectively the surfaces of continuous belts 76, 77, 78 and 79 whose function will be described more fully hereinafter.

Although, only barely discernable in FIG. 1 the continous belts each have score advance openings therethrough. In slot 48 one such opening has shown passing there-through a safe-dart tip 29. Adjacent each slot there are an individual dart scoring legends as is indicated by arrows 66, 67, 68, 69. The maximum score a single dart can count for in the game as shown is worth sixty points.

On one side of each slot there are provided unidirectional magnifying lenses 51, 52, 53 and 54. Adjacent magnifying lenses 51, 52 are player score selection lights 59, 58 whereas magnifying lenses 53, 54 have positioned as shown player score selection lights 57, 56. At the top of the face support plate are bullseye indication lamps 61 and 62.

The cooperation of the various components evidenced in FIG. 1 as well as their specific function will become evident as the description of the invention unfolds hereinafter.

Figure 2:
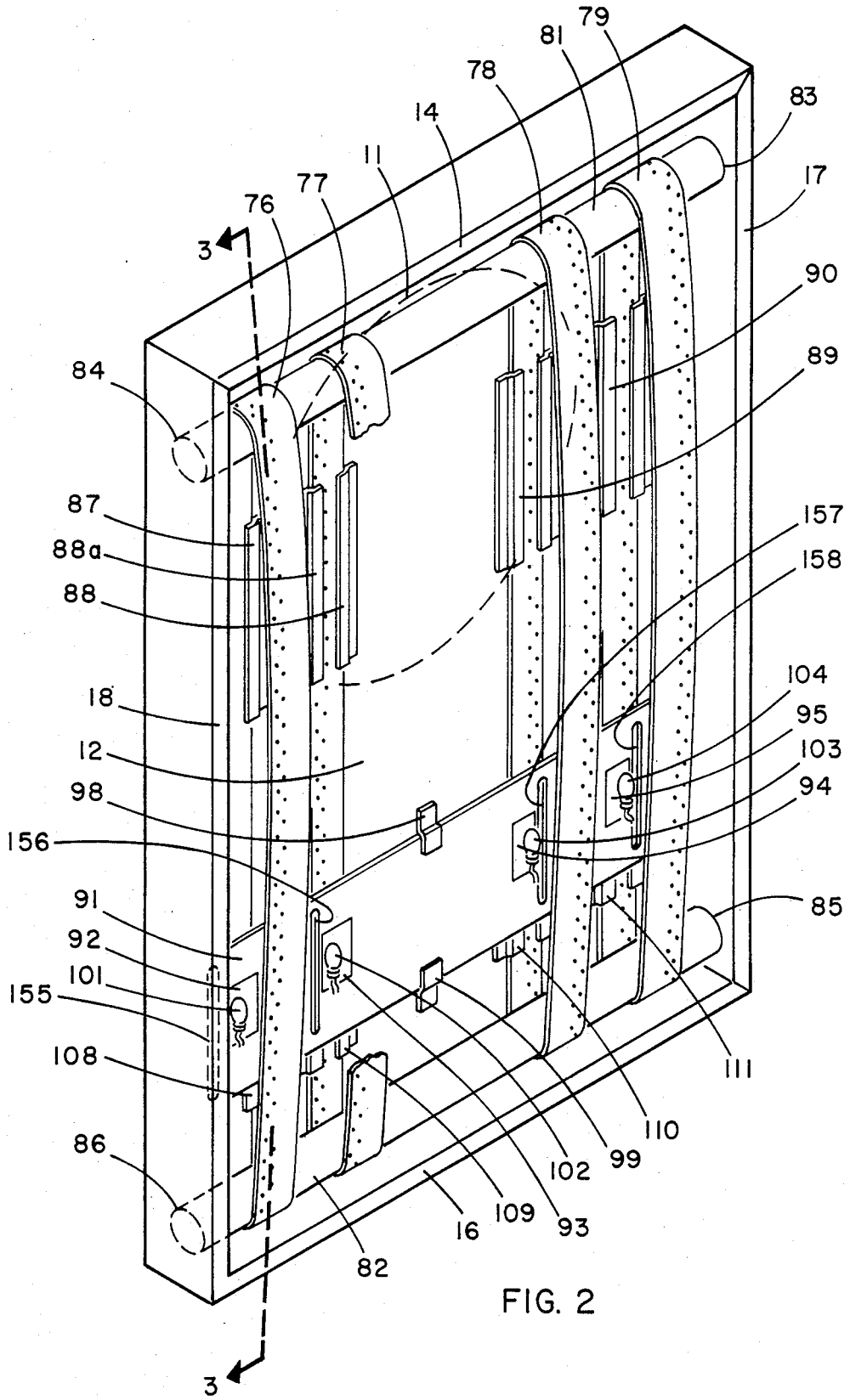
FIG. 2 illustrates in a three dimensional manner the back side of the invention of FIG. 1 with a rear cover plate removed.
Figure 3:
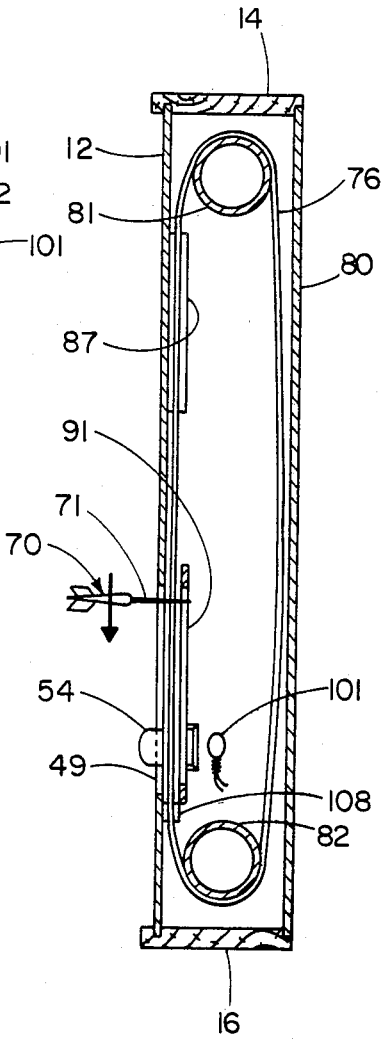
FIG. 3 is a cross-sectional view taken along the line 3—3 in FIG. 2.
Figure 4:
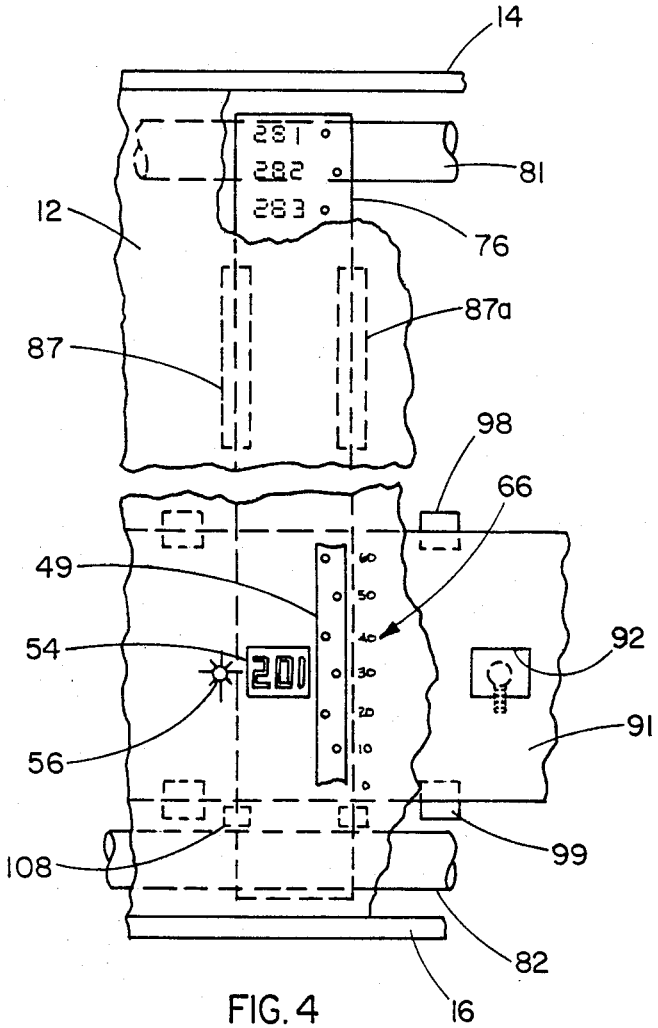
FIG. 4 is a partial sectional front view of the score keeping apparatus of the invention.

Attention is now directed to FIGS. 2, 3 and 4, which when studied in conjunction with the description that follows will further enhance the readers comprehension of the nature of operation and construction of a portion of the scorekeeping apparatus.

FIG. 2 is a three dimensional illustration of the rear side of that which is shown in FIG. 1. The only structure not shown is that structure related to the dart board 11, the bullseye deflection detection mechanism and related circuitry the moveable bullseye target plate and circuitry which is shown in detail in FIGS. 9, 10 and 14. The dart board 11 is shown in dotted outline on the face support plate 12 which in turn is mounted on upper, lower and side frame members 14 16, and 17, 18 as described hereinbefore.

Parallel non-rotatable guide shafts 81, 82 are secured at their respective ends 83, 84 and 85, 86 to side frame members 17, 18. The guide shafts 81, 82 may be fabricated of cardboard tubing and fastened to the side frame member 17, 18 by means of epoxy cement or and other suitable fastening means that ensures their non-rotable positioning relative to the side frame members 17, 18.

A guide plate 91 is secured to the rear side of the face support plate 12 by means of fastening straps, two of which are identified by reference numerals 98, 99 (see FIG. 2 and FIG. 4). In the alternative glue may be employed to bond the plate 91 to the rear side of the face support plate 12. The guide plate 91 is spaced apart from the rear side of face support plate 12 as best seen in FIG. 3. The guide plate 91 is provided with vertically disposed slots 155, 156, 157 and 158 which allow the passage of a score adjustment probe shown here in the form of a dart tip 71 as can be seen in FIG. 3 through a continuous belt 76.

Figure 5:
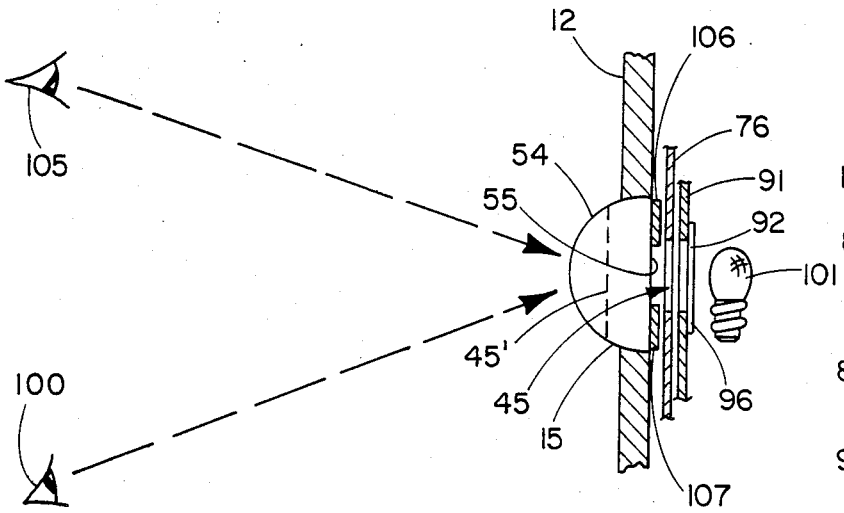
FIG. 5 is a cross-sectional view taken along a center portion of line 5—5 in FIG. 1.

The unidirectional magnifying lenses 51, 52, 53 and 54 of FIG. 4 each fit within a window, such as lens 54 in window 15, FIG. 5, in the face support plate 12.

The guide plate 91 has apertures there through each of which are positioned in alignment with one of the windows. An example of this matching relationship can be seen in FIG. 5 which features in expanded detail the relationship of a unidirectional magnifying lens 54 mounted in a window 15 of face support plate 12, a portion of continuous belt 76, guide plate 91 and a light source 101. Accordingly it will be observed that aperture 92 in guide plate 91 is in alignment with a window 15 in face support plate 12. The windows in the face support plate 12 are adjacent the slots 46, 47, 49 as shown in FIG. 1.

The structure and function of the unidirectional magnifying lenses 51, 52, 53, 54 that are positioned within each window in the face support plate can best be understood by a study of FIGS. 5, 6, 7 and 8.

In FIG. 2 there will be observed a plurality of continuous belts 76, 77, 78, 79 which are loosely carried by the non rotatable guide shafts 81, 82. All of the belts are the same, therefore an explanation of the structure and operation of any one of the belts will suffice for the remainder. It should be noted that belts 76, 77 have score adjustment openings along one edge while belts 78, 79 have similar score adjustment openings disposed along an opposite edge. Accordingly, attention is again focused on FIGS. 2 and 3 where it will be readily observed that the continuous belt 76 passes between the guide plate 91 and the face support plate 12. The belts are each guided along the rear surface of face support plate by guide members 87, 88, 88*a*, 89, 90 (see FIG. 2). As the belts exit from the space between the guide plate 91 and the face support plate 12 additional guide members 108, 109, 110, 111 provide support for the belts before they pass around non rotatable guide shaft 82.

Figure 6:
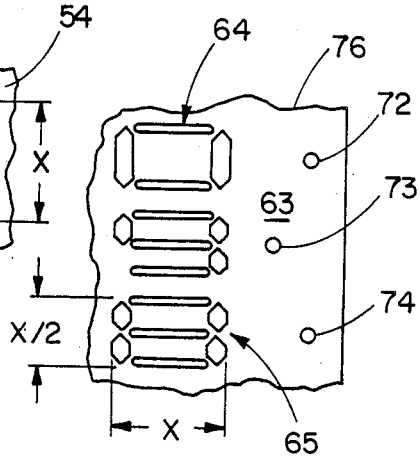
FIG. 6 is a partial sectional view of a portion of a continuous belt embodying a feature of the invention.

FIG. 6 illustrates a section of a continuous belt such as belt 76 which has an opaque background into and through which transparent numbers 64, 65 have been formed. Each digit e.g. reference numeral 65 of the number has one of its dimensions "x" reduced to thereby provide each digit of a number which is substantially wider than its height. The belts are also provided with score advance openings 72, 73, 74 there through, as shown, adjacent each of the transparent numbers.

The continuous belts are moveable between the guide plate 91 and the face support plate 12 such that the digits of the numbers will appear consecutively at the window upon movement of the belt around the guide shafts 81, 82. Note in FIG. 3 the "safe dart" 70 has its dart tip 71 passing through a score advance opening in the belt 76. The dart tip 71 passes through the slot 49 in the face support plate 12 and the dart is moveable in a downward direction as indicated by the arrow passing through the dart 70.

Figure 7:
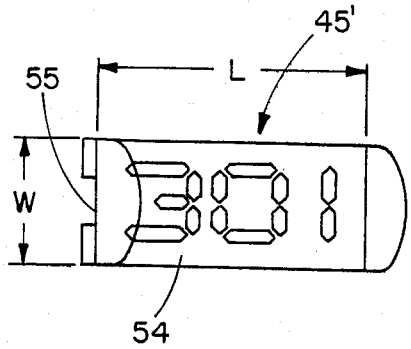
FIG. 7 is a front view of an undistorted players score number that demonstrates a facet of the invention, FIG. 8, in a manner similar to FIG. 7 illustrates an undistorted digit as it appears to a viewer.

The score advance openings will simultaneously appear within a slot such that the manual insertion of a score adjusting device e.g. dart tip 71 of dart 70, within score advance opening in the belt will allow a player by downward movemen of the dart to the bottom of the slot to adjust the players score as evidenced by an illminated magnified image 110, FIG. 7.

Figure 8:
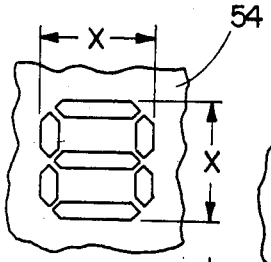

FIG. 8 illustrates a resultant magnified image of a single digit and reveals that the digit appears undistorted as a consequence of the unidirectional magnify lenses.

FIGS. 5 and 7 reveal the structural details of the unidirectional magnifying lens 54 which is shown in cross section in FIG. 5 and three dimensionally in FIG. 7. The lens 54 has a semicylindrical cross section which has a curved external surface as shown, as well as, a flat planar portion 55 which planar portion is parallel to the surface of a belt 76 passing thereby. The lens 54 has a length "l" greater than its width "w" and is so configured as to matingly fit within the window 15. The lens 54 positioned as shown within the window 15 provides magnification only across its width. A mask in the form of strips 106, 107 cooperate with the planar surface 55 to provide a dimensionally controlled image field to thereby limit the dimensions of an image field to be magnified. The transparent number as indicated by reference numerals 64, 65 in cooperation with the aperture 92 defines the image field and the light source 101 provides illumination for the image field. Vertically disposed dot/dash line 45' indicates the apparent image of the number within the image field.

Schematically shown in FIG. 5 are players eyes 100 and 105 portrayed as being at differing relative heights in respect of the lens 54. The eye 100 is intended to represent the eye of the shorter of two hypothetical players. One of the unique features of the invention resides in the fact that players of differing heights may play the game and always maintain an undistorted view of the various players scores because of the novel arrangement of the scoring apparatus.

Reference is now made specifically to FIG. 4 which illustrates in a partial section a front view of a portion of the invention absent the dart board. The face support plate 12 has shown adjacent the slot 49 a series of numbers from zero to sixty which represent dart score legend. In one type of regulation safe dart game the highest score a single dart can score is sixty (60) and each player begins his first turn at play, for example with "301" points. Each player will throw his set of darts and as he removes each dart from the board he will take dart tip of the removed dart as shown in FIG. 1 and FIG. 3 and insert the tip in a score advance opening and pull downward in the manner indicated by the arrow shown in association with dart 70, FIG. 3 until the dart tip is at the bottom of the slot 49. This just described movement results in the belt 76 being drawn over nonrotatable shaft 81 which brings, for example, the number "201"into focus in the lens 54. The first player to reach zero is the winner.

Figure 9:
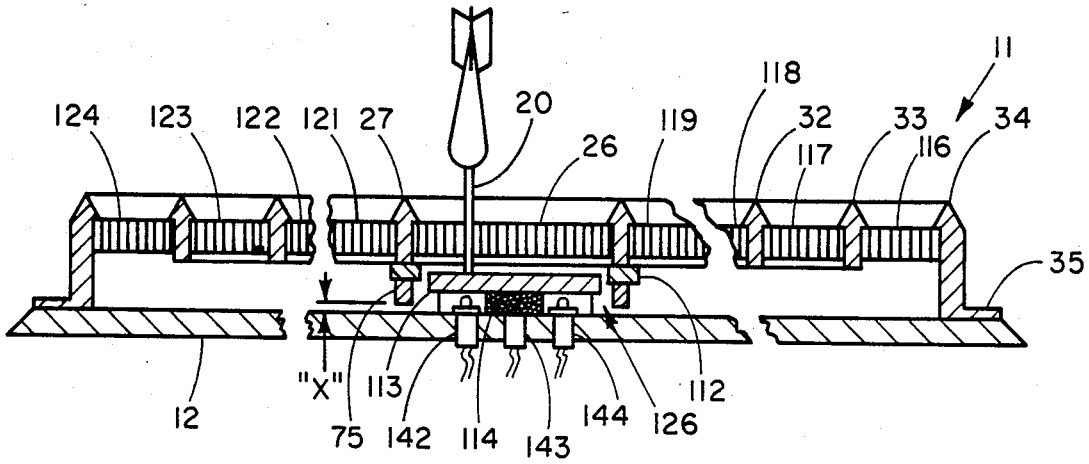
FIG. 9 is a cross sectional view of a preferred embodiment of the invention target plate deflection action mechanism.
Figure 10:
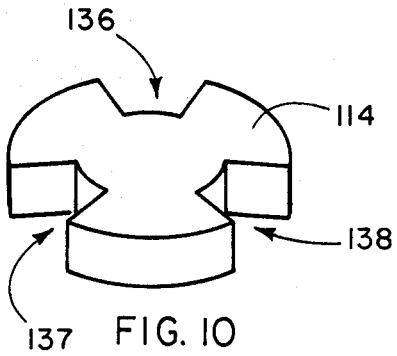
FIG. 10 is a three dimensional illustration of resilient member employed in the target plate deflection detection mechanism of FIG. 9.

Reference is now made to FIG. 9 which shows in cross-section a dart board 11 taken along line C—C in FIG. 1 where all the target plates 116, 117, 118, 119, 121, 122, 123, 124 are nonmoveable in respect of the radial (not shown) and segmented circular ribs 32, 33, 34. A bullseye target plate 26 is rigidly secured within an annular rib 27. Each target plate may be secured in place by a suitable fastening technique such as expox cement or thermal bonding where the dart board construction and materials are suited for such a bonding techniques. It is concievable that the entire dart board may be injection molded. Present dart board manufacturing techniques call for the independent manufacture of the target plates and the radial/segmented rib structure followed by the target plates being secured within the various ribs.

Figure 11:
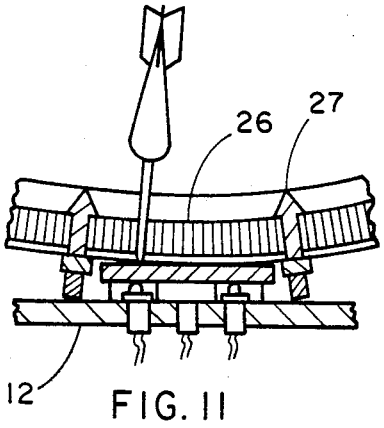
FIG. 11 is a cross sectional illustration showing in exaggerated detail the operation of the deflection detection mechanism of FIG. 9.

Because the dart boards are normally made of injection molded plastic the overall structure of the dart board absent the bullseye target plate deflection detection mechanism is one wherein the center of the dart board, i.e. at the bullseye target plate, may be flexed or deflected along a line at right angles to the dart board 11. The fact of the matter is that the central region of the dart board 11 is flexible and will respond when struck by a dart in the bullseye target plate 26 by physically deflecting. FIG. 11 is an attempt to show graphically in an exaggerated manner the nature of the above noted deflection.

The face support plate 12 is positioned in a plane parrallel to the target plates 116, 117, 118, 119, bullseye target plate 26 and target plates 121, 122, 123, 124.

It will be recalled that the target plates and ribs are integrally secured one to each other and as can be seen in FIG. 9 are supported at the periphery of the dart board 11 by annular rib 34 which in turn has integral circular flange 35 in contact with the face support plate 12.

The bullseye target plate is shown in this embodiment with a retaining ring 112 integrally secured to annular rib 27 by spot thermo welding not shown. A rigid disc 113 is positioned as shown and has an overall configuration which matches the bullseye target plate 26. A resilient member 114 which may be of sponge or foam like material is secured by adhesive (not shown) to the face support plate 12 as well as the rigid disc 113.

As can be seen in FIG. 9 the rigid disc 113 is normally spaced apart from the bullseye target plate 26 and is positioned in a plane parallel to the face support plate.

Integral with the retaining ring 112 is a spacing collar 75 which has a vertical dimension as viewed in FIG. 9 such that the spacing collar 75 is positioned at a distance "X" from the face support plate 12 which is slightly more than a given maximum deflection of the bullseye target plate 26. The spacing collar 75 acts as a limit stop to thereby ensure that projectile impact and resulting target plate deflection is limited to thereby protect the micro switches 142, 143, and 144 from excessive shock loading. The microswitches 142, 143, 144 are fitted through unreferenced openings in the face support plate 12 as shown. The overall configuration of the resilient member 114 can best be appreciated by a study of FIG. 10 which shows in a three dimensional manner the resilient member 114 with portions 136, 137, 138 removed. When the resilient member 114 is in position as shown in FIG. 9 the microswitches 142, 143, 144 are disposed within the spaces provided by the removed portions.

In operations, upon the impact of the projectile tip 20 the bullseye target plate 26 is deflected through a given distance and then the tip 20 strikes the rigid disk 113 and thereby causes the resilient member 114 to be compressed which allows the rigid member, in turn, to engage one of the microswitches to cause the switch to be actuated and provide a bullseye indication as be described herein after.

Figure 12:
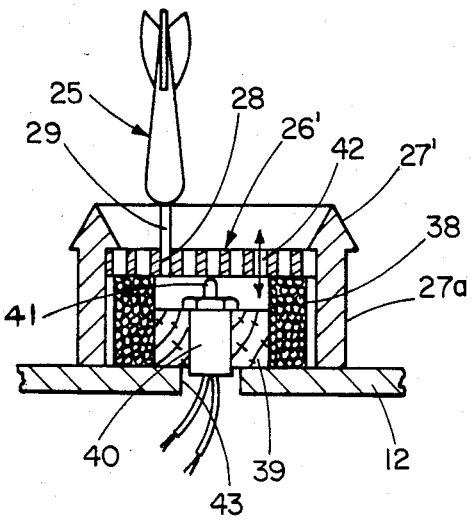
FIG. 12 is a cross-sectional showing of another embodiment of the deflection detection mechanism of the invention.

FIG. 12 shows another embodiment of the invention wherein the dart board is provided with a bullseye target plate 26' which is moveably mounted in an annular rib 27'. In this embodiment the annular rib 27' is provided with a tubular portion **27*a* which rests upon the face support plate 12. Positioned between the bullseye target plate 26' and the face support plate 12 is a cylindrical resilient member 38. A switch support block 39 is shown having a microswitch 40, with microswitch actuating element 41 centrally disposed within the cylindrical resilient member 38. The operation of this embodiment of the invention is straight forward in that the dart 25 with dart tip 29, when thrown strikes the bullseye target plate 26' and enters aperture 28 whereupon the target plate moves as shown by direction of travel arrow 42, which results in the compression of cylindrical resilient member 38 and the actuation of switch 40 is a result of the movement of microswitch actuating element 41. An opening 43 is provided in the face support plate 12** to allow for the passage of electrical leads, unreferenced, to an audible and/or visual indication apparatus described hereinafter.

Figure 13:
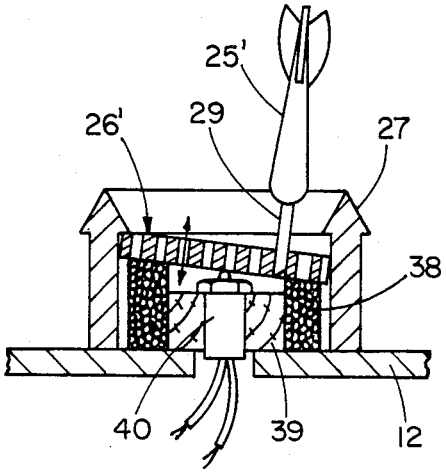
FIG. 13 is a cross-sectional showing in exaggerated detail showing the operation of the mechanism of FIG. 12.

FIG. 13 is intended to convey graphically the operation of the bullseye indication mechanism of FIG. 12 wherein a dart 25' with its dart tip 29 has struck the bullseye target plate 26' off center.

Figure 14:
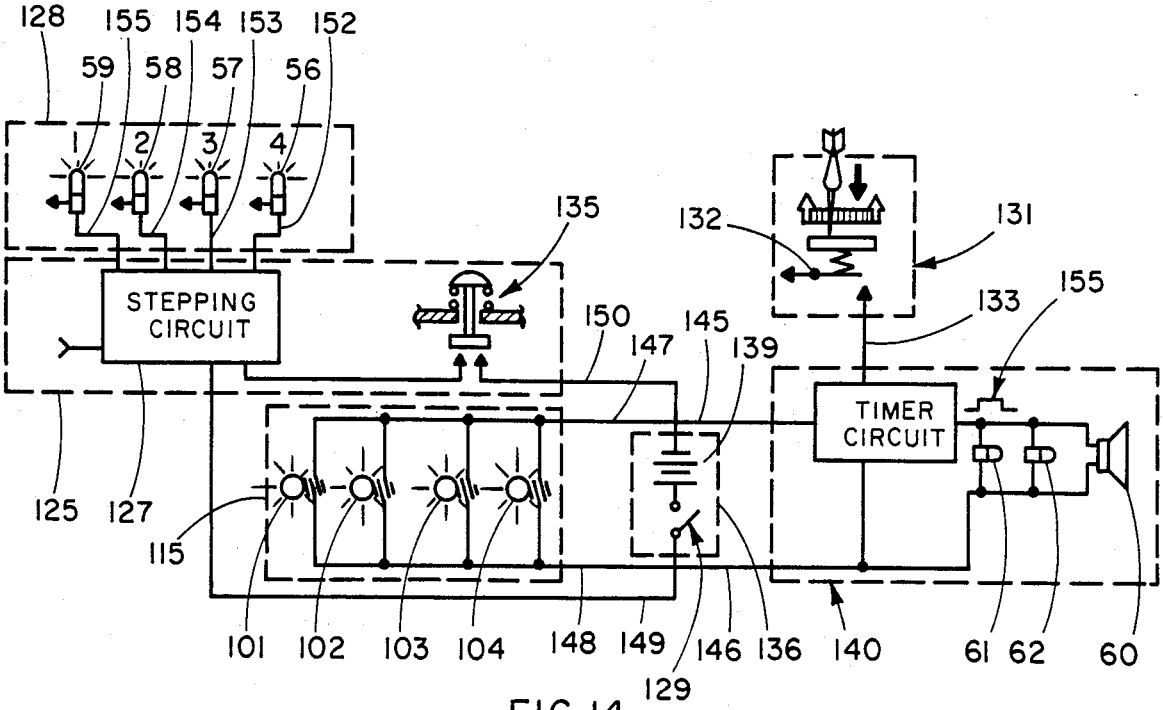
FIG. 14 is a circuit diagram of the electrical features of the invention.

Reference is now made to FIG. 14 in which there is shown in block diagram form a schematic of electrical circuitry suitable for the practice of this invention. Various major components of the circuitry are shown blocked in a dashed line manner.

A controllable source of power 136 here shown as a battery with ON/OFF switch 129 is electrically coupled to a bullseye indication circuit 140 via lead 145, 146, via lead 147, 148 to a player score light source circuit 115, and via leads 149, 150 to a player selection circuit 125. It should be understood that a tranformer and rectifying bridge may be substituted for the battery when and if it is desired to use household power in the power source. The bullseye indication circuit 140 is electrically connected via lead 133 to the bullseye deflection detection mechanism 131.

The player selection circuit 125 is electrically connected to a player selection light array 128 via leads 152, 153, 154, 155.

The operation of the electrical circuitry of FIG. 14 is uncomplicated. The turning "ON" of switch 129 immediately provides power from the battery 139 to player score lights 101, 102, 103, 104 while at the same time energizing timer circuit 141 and stepping circuit 127 via player selection switch 135 the stepping circuit 127 and timer circuit 141 are conventional commercially available units. The stepping circuit 127 operates to sequentially turn on each of the player selection lights 56, 57, 58, 59 while the timer circuit 141 provides a turn on signal 155 for the bullseye indication lights 61, 62 and audible bullseye alarm 60.

Although this invention has been illustrated and described in connection with the particular embodiment illustrated, it will be apparent to those skilled in the art that various changes may be made therein without departing from the spirit of invention as set forth in the appended claims.

We claim:

1. A scorekeeping apparatus in combination with a projectile target game, said apparatus and target game including;

a projectile receiving target secured to a surface of a face support plate means which is mounted on a frame means, which has an upper end and a lower end, slot means in said face support plate means to thereby provide an opening through said face support plate, parallel non-rotatable guide shafts secured at their respective ends to said frame means upper and lower ends with said non-rotatable guide shafts on one side of said face support plate and said target on the other side thereof, window means in said face support plate means adjacent said slot means, unidirectional magnifying means having a length greater than its width, said magnifying means configured to matingly fit within said window means, said unidirectional magnifying means when positioned in said window means providing magnification only across its width, mask means cooperating with a surface of said unidirectional magnify means to provide a dimensionally controlled image field to thereby limit the dimensions of an image field to be magnified, a player score light source means positioned adjacent said window means and on the same side of said face support plate as said parallel non-rotatable guide shafts, said player score light source means thereby providing illumination to said image field when said player score light source means is turned "ON", a guide plate means secured to said face support plate means in a spaced apart manner between said player selection light source means and said face support plate means, said guide plate means having an aperture means there through which is positioned to matingly match said window means, a continuous belt means loosely carried by said non-rotatable guide shafts, said belt passing between said guide plate and said face plate, said continuous belt means having an opaque background into and through which numbers have been formed and which light can pass, each digit of said numbers having one of its dimensions reduced to thereby provide each digit of a number that is substantially wider than its height, said width of said magnifying means, extending parallel to the height of said digits on said belt means, said continuous belt means having score advance openings there through adjacent each of said transparent numbers, said continuous belt means moveable between said guide plate and said face support plate such that said digits of said numbers will appear consecutively at said window means upon movement of said belt means around said guide shafts, said score advance openings simultaneously appearing within said slot means whereby the manual insertion of a score adjusting means within said score advance openings in said belt means will allow a player by movement of said score adjustment means towards an end of said frame to thereby adjust said players score as evidenced by an illuminated magnified image of said numbers appearing within said window means, said target having a bullseye target deflection detection means, a controllable source of power electrically coupled to a bullseye indication means, said score light source means and a player selection means, said bullseye indication means controlled by said bullseye deflection detection means and said player selection means controllingly coupled to a player selection light means, said bullseye indication means providing an indication that said bullseye target has been deflected as a consequence of being struck by a projectile, while at the same time there is provided an illuminated image of a players score as indicated by said score light source means.

2. The apparatus and target game of claim 1 wherein said face support plate means has adjacent said slot means a series of numbers on said surface of said face support plate means ranging from zero to a number that represents the highest number that a player can obtain by a single projectile score of said projectile target game, said continuous belt means having at lease one series of said transparent numbers that range from zero to a maximum number that represents a completed game score.

3. The apparatus and target game of claim 1 wherein said slot means, includes as many slots as there are players.

4. The apparatus and target game of claim 3 wherein said window means includes as many window as there are slots.

5. The apparatus and target game of claim 4 wherein said continuous belt means includes as many score belts as there are slots.

6. The apparatus and target game of claim 5 wherein said unidirectinal magnify means is a magnify lens, having a semi cylindrical cross section with as many lens as there are slots.

7. The apparatus and target game of claim 6 wherein said semi cylidrical cross section lens has a flat planar portion which is parallel to a surface of a belt passing thereby.

8. The apparatus and target game of claim 7 wherein said mask means is opaque and is adjacent said flat planar surface of each of said lens.

9. The apparatus and target game of claim 8 wherein said guideplate means having aperture means includes as many guide plates each having an aperature therethrough as there are slots.

10. The apparatus and target game of claim 9 wherein said controllable player selection light source means includes as many light emiting devices as there are slots.

11. The apparatus and target game of claim 10 wherein said face support plate means was adjacent each of said slot means a series of members on said surface of said face support plate means, said numbers ranging from zero to a number that represents the highest number that a player can obtain by a single projectile of said projectile target game, each of said score belts having at least one series of said transparent numbers that range from zero to a maximum number that represents a completed game score.

12. A game score keeping apparatus including in combination: a face support plate means which is mounted on a frame means which has an upper and lower end, slot means in said face support plate means to thereby provide an opening through said face support plate, parallel non-rotatable guide shafts secured at their respective ends to said frame means upper and lower ends with said non-rotatable guide shafts on one side of said face support plate, window means in said face support plate means adjacent said slot means, unidirectional magnifying means having a length greater than its width, said magnifying means configured to matingly fit within said window means, said unidirectional magnifying means when positioned in said window means providing magnification only across its width, mask means cooperating with a surface of said unidirectional magnify means to provide a dimensionally controlled image field to thereby limit the dimensions of an image field to be magnified, a controllable score light source means positioned adjacent said window means and on the same side of said face support plate as said parallel non-rotatable guide shafts, said score light source means thereby providing illumination to said image field when said controllable score light source means is turned "ON", a guide plate means secured to said face support plate means in a spaced apart manner between said player selection light source means and said face support plate means, said guide plate neans having an aperture means therethrough which is positioned to matingly match said window means, a continuous belt means loosely carried by said non-rotatable guide shafts, said belt passing between said guide plate and said face plate, said continuous belt means having an opaque background into and through which numbers have been formed and which light can pass, each digit of said numbers having one of its dimensions reduced to thereby provide each digit of a number that is substantially wider than its height, said width of said magnifying means extending parallel to the height of said digits on said belt means, said continuous belt means having score advance openings there through adjacent each of said transparent numbers, said continuous belt means moveable between said guide plate and said face support plate such that said digits of said numbers will appear consecutively at said window means upon movement of said belt means around said guide shafts, said score advance openings simultaneously appearing within said slot means whereby the manual insertion of a score adjusting means within said score advance in said belt means will allow a player by movement of said score adjustment means towards an end of said frame to thereby adjust said players score as evidenced by an illuminated magnified image of numbers appearing within said window means and said image field, said magnified image presenting a numeral wherein each digit thereof appears to have equal width and hegith without regard to the relative angle a players eye is in respect of said unidirectional magnify means.

13. The game scoring apparatus of claim 12 wherein said unidirectional magnify means is a magnifying lens having a semi cylindrical cross-section.

14. The apparatus of claim 13 wherein said semi-cylindrical cross-section lens has a flat planar portion which is parallel to a surface of said continuous belt in the vicinity of said window means.

15. The apparatus of claim 14 wherein said mask means is of opaque material and is adjacent said flat planar surface of said lens.

16. The apparatus of claim 15 wherein said face support plate means has adjacent said slot means a series of numbers on a side of said support plate means remote from the side of said support plate means on which said non rotatable guide shaft are positioned, said series of members ranging from zero to a number that represents the highest number that a player can score with a single projectile.

said continuous belt means having at least one series of said transparent numbers that range from zero to a maximum number that represents a completed game score.

17. A projectile target game board in combination with a bullseye indication nechanism; said combination including a game board having a bullseye target plate means integrally secured in a deflectable target plate carrying rib means, said bullseye target plate means having a plurality of preformed apertures therein to receive upon impact a projectile tip of a projectile thrown at said game board bullseye target plate, a support means positioned in a plane parallel to said target plate means and mechanically coupled to said rib means at at least two points remote from said target plate such that said projectile tip impacting in one of said bullseye target plate means apertures causes said rib means to deflect at least a given distance, a rigid member means having an overall configuration which matches said bullseye target plate means, a resilient means secured to said support means and said rigid member means, said rigid member means spaced apart from said bullseye target plate and positioned in a plane parallel to said support means, and switch means carried by said support neans, said switch means located within said resilient means and positioned such that upon said impact of said projectile tip, said target plate is deflected through said given distance and then said projectile tip strikes said rigid member and thereby causes said resilient means to be compressed which allows said rigid member to engage said switch means to cause said switch means to be actuated and provide said bullseye indication.

18. The combination of claim 17 wherein said bullseye target plate is centrally disposed on said projectile game board.

19. The combination of claim 18 wherein said mechanical coupling to said rib means is at a periphery of said projectile game board.

20. The combination of claim 19 wherein said resilient means is of a sponge like construction of uniform thickness having at least three portions thereof at its periphery removed to accomodate said switch means.

21. The combination of claim 20 wherein said switch means consists of three separate switch mechanisms each one of which is disposed within said removed portions of said resilient means.

22. The combination of claim 19 wherein said rib means has integral therewith an annular tube shaped member means surrounding said bullseye target plate, said annular tube shaped member means having physically coupled thereto a spacing collar means of a dimension such that said spacing collar means is positioned at a distance from said support means that is slightly more than said given deflection distance to thereby ensure that said projectile impact and resulting target plate deflection is limited to thereby protect said switch means excessive shock loading.

23. A projectile target game board bullseye indication mechanism, said mechanism including in combination:

a game board having a moveable bullseye target plate means mounted for reciprocal movement in a target plate carrying rib means, said bullseye target plate means having a plurality of preformed apertures therein to receive a projectile tip of a projectile thrown at said game board bullseye target plate, said rib means having integral therewith an annular tubular member surrounding a periphery of said bullseye target plate, support means positioned in a plane parallel to said target plate means and mechanically coupled to said rib means, said annular tubular member having a portion thereof in contact with said support means, a cylindrical shaped resilient means engaging a surface of said support means as well as a surface of said target plate and interposed between said bullseye target plate means and said support means, switch means carried by said support means, said switch means located within a central opening in said cylindrical shaped resilient means and positioned such that upon impact of said projectile tip in one of said apertures of said target plate said bullseye target plate is moved against the cylindrical shaped resilient means and said target plate strikes said switch means to cause said switch means to be actuated and provide said bullseye indication.

* * * * *